US012193571B2

(12) United States Patent
Graber et al.

(10) Patent No.: US 12,193,571 B2
(45) Date of Patent: Jan. 14, 2025

(54) FLOATING FIXTURE WALL MOUNT SYSTEM AND METHOD OF USE

(71) Applicant: InnovaShelf LLC, Odon, IN (US)

(72) Inventors: Laban Graber, Odon, IN (US); Delbert Kemp, Montgomery, IN (US)

(73) Assignee: InnovaShelf LLC, Odon, IN (US)

( * ) Notice: Subject to any disclaimer, the term of this patent is extended or adjusted under 35 U.S.C. 154(b) by 476 days.

(21) Appl. No.: 17/525,487

(22) Filed: Nov. 12, 2021

(65) Prior Publication Data

US 2022/0151385 A1 May 19, 2022

Related U.S. Application Data

(60) Provisional application No. 63/113,291, filed on Nov. 13, 2020.

(51) Int. Cl.
*A47B 96/06* (2006.01)

(52) U.S. Cl.
CPC ..... *A47B 96/066* (2013.01); *A47B 96/067* (2013.01)

(58) Field of Classification Search
CPC ... A47B 96/067; A47B 96/066; A47B 95/008; A47B 96/07; A47B 96/068
USPC ..... 211/87.01; 312/245, 242; 248/225.21, 248/274.1
See application file for complete search history.

(56) References Cited

U.S. PATENT DOCUMENTS 3,025,122 A * 3/1962 Millman ..... A47B 96/061 248/225.11
3,565,502 A 2/1971 Bracy
4,401,222 A * 8/1983 Kulikowski ..... A47F 5/0025 211/94.01
4,828,120 A * 5/1989 Beil ..... B42F 7/145 D6/567
5,050,832 A * 9/1991 Lee ..... A47B 95/008 248/222.51
5,197,703 A * 3/1993 Pratolongo ..... A47B 96/07 248/225.11
5,222,611 A * 6/1993 Wood ..... A47B 96/06 248/339
5,351,924 A * 10/1994 Schroder ..... A47B 95/008 248/274.1
5,624,168 A * 4/1997 Licciardello, Sr. .. A47B 95/008 211/94.01
5,718,493 A * 2/1998 Nikolai ..... A47B 88/941 403/68
5,964,438 A * 10/1999 Camilleri ..... A47B 95/008 248/323
7,083,056 B2 * 8/2006 Routhier ..... A47B 95/008 211/90.04
7,469,979 B2 * 12/2008 Tupper ..... E05B 65/462 312/348.4
8,444,235 B2 5/2013 Gmerek
(Continued)

FOREIGN PATENT DOCUMENTS

WO WO-2022104093 A2 * 5/2022 ..... A47B 96/066

*Primary Examiner* — Jennifer E. Novosad
(74) *Attorney, Agent, or Firm* — Overhauser Law Offices, LLC

(57) ABSTRACT

A floating fixture system and method includes wall attachment members and mounting brackets for mounting a fixture on a wall so it floats from the wall. Hook and hook-receiving structures temporarily hold the fixture to the wall while additional components more permanently secure the fixture to the wall.

9 Claims, 9 Drawing Sheets

(56) References Cited

U.S. PATENT DOCUMENTS

| | | | | |
|---|---|---|---|---|
| 8,646,624 | B2 | 2/2014 | Fernandez | |
| 9,033,294 | B2 * | 5/2015 | Cattaneo | A47B 95/008 248/221.11 |
| 10,441,078 | B1 * | 10/2019 | King | A47B 91/02 |
| 10,602,843 | B2 * | 3/2020 | Sisto | F16B 47/003 |
| 11,013,326 | B2 * | 5/2021 | Graber | A47B 95/008 |
| 11,412,850 | B2 * | 8/2022 | Sisto | A47B 95/008 |
| 2007/0056921 | A1 * | 3/2007 | Lo | F16M 11/046 211/94.01 |
| 2008/0224579 | A1 * | 9/2008 | Juten | A47B 96/067 312/111 |
| 2011/0210087 | A1 * | 9/2011 | Aberg | A47B 96/067 211/94.01 |
| 2016/0045025 | A1 * | 2/2016 | Trunkle | F16M 13/02 248/231.91 |
| 2017/0143120 | A1 * | 5/2017 | Cattaneo | A47B 95/008 |
| 2020/0178688 | A1 * | 6/2020 | Graber | A47B 96/07 |
| 2021/0045531 | A1 * | 2/2021 | Sisto | A47B 96/027 |
| 2022/0018635 | A1 * | 1/2022 | Ahle | A47F 5/08 |
| 2022/0151385 | A1 * | 5/2022 | Graber | A47B 96/067 |

* cited by examiner

FLOATING FIXTURE WALL MOUNT SYSTEM AND METHOD OF USE

FIELD OF THE INVENTION

The present invention relates to a system and method for the installation of a floating fixture such as a vanity, cabinet, desk, bench, dresser, nightstand or shelf to a wall. Floating fixtures are those in which some or all of the weight of the fixture is supported by a wall, and the weight is not supported by a floor.

BACKGROUND

The present disclosure is directed toward systems and methods to create and mount floating fixtures, such as vanities, to a wall. Floating fixtures are increasing popular because they are more aesthetically pleasing, provide improved handicapped access, and make cleaning underneath the fixture easier, especially by the robotic vacuums and the like.

A common way to attach floating fixtures such as vanities to walls is using a strip of wood that runs along the back of the fixture and that attaches to the inside of each side of the vanity. However, if too much weight is placed on the front end of the fixture, the pressure tears the strip of wood away from the sides of the fixture or the wall.

Another system in the prior art uses a bulky block in each corner of the fixture the wall. However, this approach does not allow a full-length drawer at the top of the fixture. It is also complicated to install and does not have a rail located on the back of the vanity. This requires that the vanity be placed on the wall so that the block(s) abut a stud in the wall. This may not be the desired location for the fixture.

It is therefore desirable to provide a mounting system for a floating fixture that maximizes the usable space between the sides of fixture. It is also desirable to provide a fixture mounting system having components that are not visible once the fixture is mounted to a wall, so that the aesthetic appearance of the fixture is improved. It is also desirable to provide a floating fixture mounting system and method that can be placed at any location along a wall, even if there are not enough wall studs to anchor the fixture to using conventional mounting systems.

Another issue with prior wall-mounted fixture systems is the difficulty of installation due to their bulky size or weight. Traditionally, an installer must hold the heavy floating fixture off the ground while screwing the fixture in place, which is difficult and typically requires multiple people. Therefore, it would be desirable to provide a system that allows the floating fixture to be held off the ground without the need for the installer(s) to physically hold the weight of the fixture in place while mounting it to a wall, or that allows a single person to install even a large or heavy fixture by themselves.

Another shortcoming with prior wall-mounted fixture systems is that they may require that installation components be cut to at the location where the fixture is to be installed. This is often required because the fixtures can be of virtually any width, and sizes are often dictated by the dimensions of the room in which they are to be installed and the location of other items in the room such as toilets or bathtubs or nearby walls. Prior systems often require that mounting components be cut to size at the installation site. For the do-it-yourself homeowner, a system that requires components to be cut is undesirable because cutting is inherently dangerous and prone to imprecision.

Another shortcoming with prior wall-mounted fixture systems is that they do not work, or result in an unattractive installation, if the wall is not perfectly plumb or flat. This problem is especially problematic with older houses or buildings that have settled and thus have warped or imperfect wall surfaces.

Finally, it is desirable to provide a wall-mountable fixture system and method that can safely hold heavy fixtures. For example, solid granite tops are increasing desirable, but they can be so heavy that they cannot be used for wall-mounted floating fixtures.

SUMMARY OF THE INVENTION

The disclosed system and method have several unique features. A wall attachment member having a hook-receiving structure may be secured to a wall, and a mounting bracket having a hook may be secured to the fixture. The fixture may then be lifted so the hook engages the hook-receiving structure on the wall attachment member. This arrangement temporarily holds the fixture to the wall, while additional attachment components may be used to more permanently secure the fixture to the wall.

A brace may be used to connect two more wall attachment members together. This distribute the weight of the fixture among the wall attachment members, which is especially helpful when all wall attachment members cannot be secured to a wall stud. In addition, it allows a brace in combination with the wall attachment member to be used to mount a fixture of varying widths. This flexibility allows fixture manufacturers to include the same wall mounting kits with fixtures of varying widths, and eliminates the need for an installer to cut components to size at the installation site.

The disclosed system also works with walls that are not perfectly plumb, as the components cooperate to pull the fixture flush against the wall. This is facilitated by slots in the mounting brackets that are secured to the side walls of the fixture. As each bracket has its own slot, they can be independently adjusted to account for imperfections in the wall surface.

The disclosed system also permits maximum utilization of the space within the fixture. The mounting components are thin and occupy a minimum amount of space in the upper back and upper sides of the interior of a fixture. This maximizes utilization of the interior space for other components such as drawers, sinks, cables, appliances and the like.

This invention is also helpful to hang floating vanities that are wheelchair accessible because those vanities are typically smaller and this system is very compact but holds a lot of weight. The metal brackets extend inward from the back of the vanity approximately 10 inches which gives additional holding power.

Because the adjustment of the vanity is all completed prior to putting the top on, the vanity is also easier to adjust. Further, the system is hidden once the countertop has been placed and does not get in the way of any drawer that might be in the vanity.

BRIEF DESCRIPTION OF THE DRAWINGS

FIG. 7 shows the right-hand bracket screwed onto the side of the floating fixture.

FIG. 8 shows the floating fixture being hung on the mounting track by the lips on the left and right brackets.

FIG. 9 shows brace which may be used to connect multiple wall attachment members in a linear orientation.

DETAILED DESCRIPTION

In one embodiment, a fixture manufacturer may provide a fixture with a mounting kit for mounting the fixture to a wall to so it floats. The kit may comprise at least one mounting brackets, at least one wall attachment member and a securement means such as channel nuts for securing the mounting bracket(s) to the wall attachment member(s).

Figure 1:
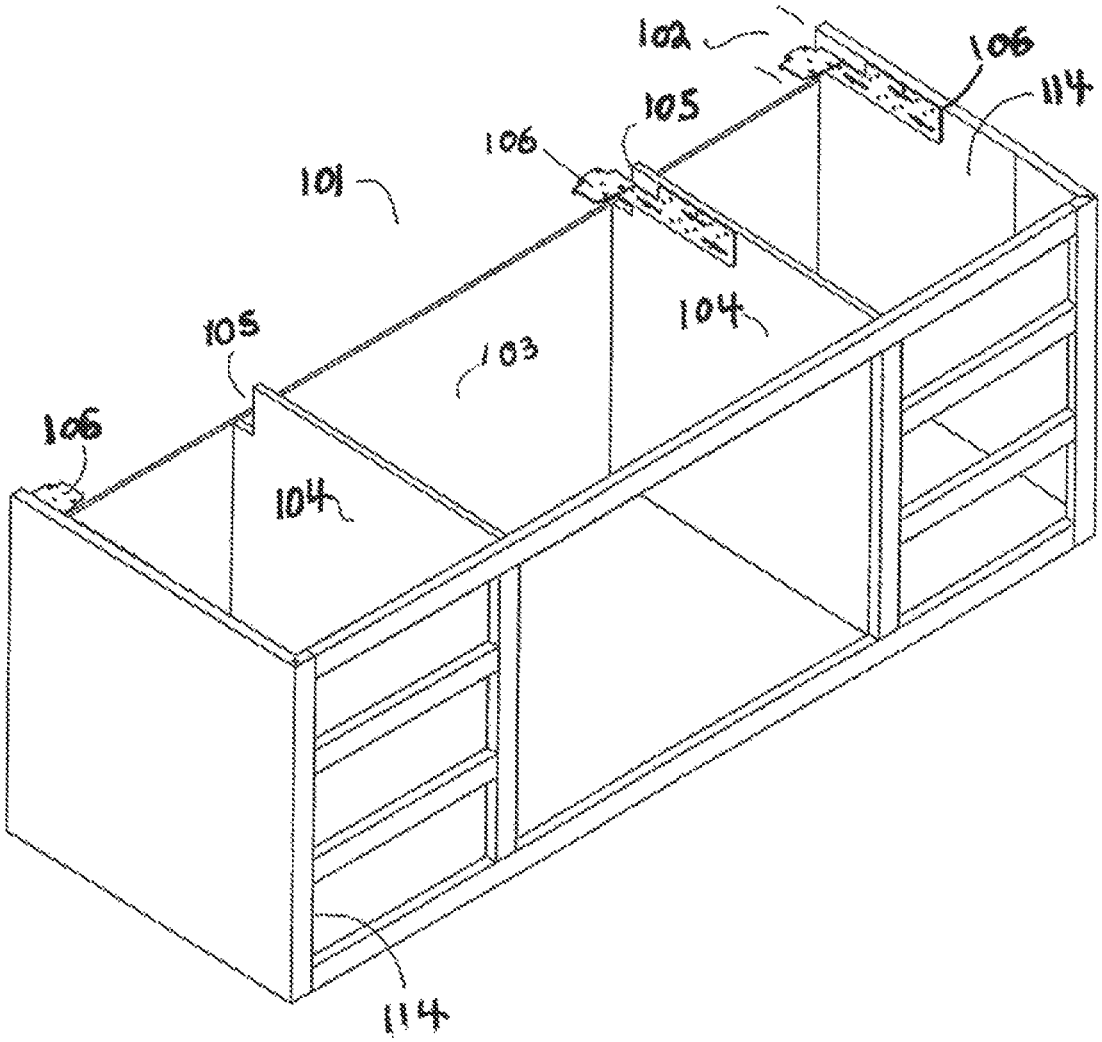
FIG. 1 shows a representative fixture suitable for mounting with attached mounting brackets.

Referring to FIG. 1, the top 3" 102 of the back 103 of the fixture may be open (no back) to leave room for the wall attachment members. Any center partitions 104 may have a notch at the top.

Figure 2:
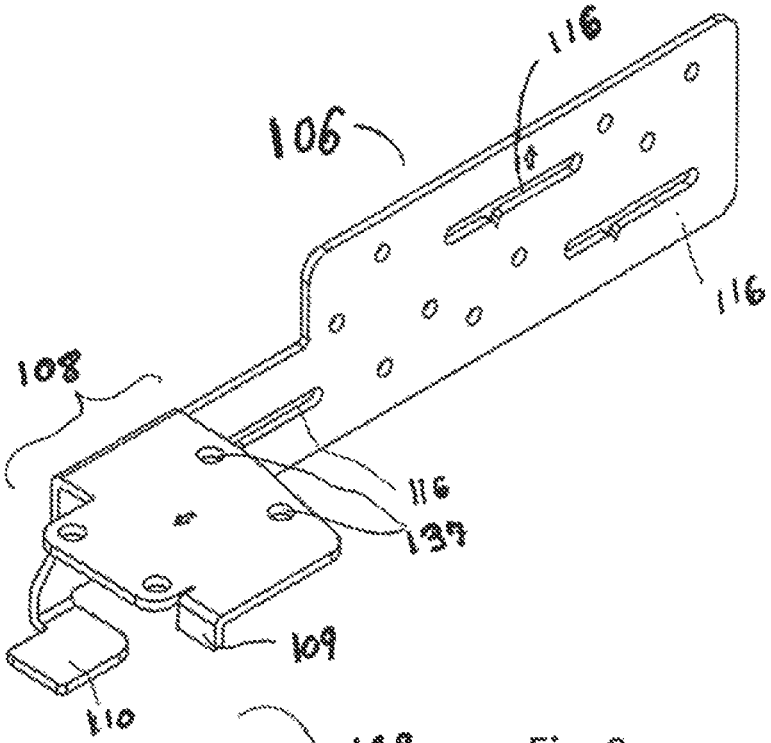
FIGS. 2 and 3 are perspective views of mounting brackets.
Figure 3:
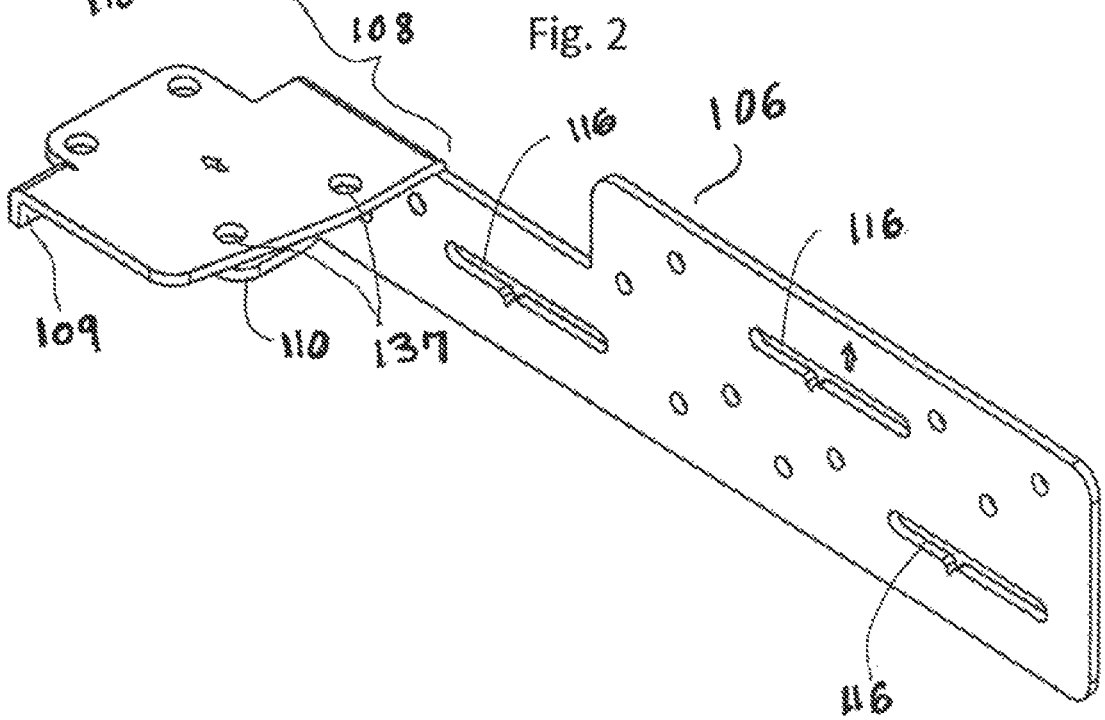
Figure 4:
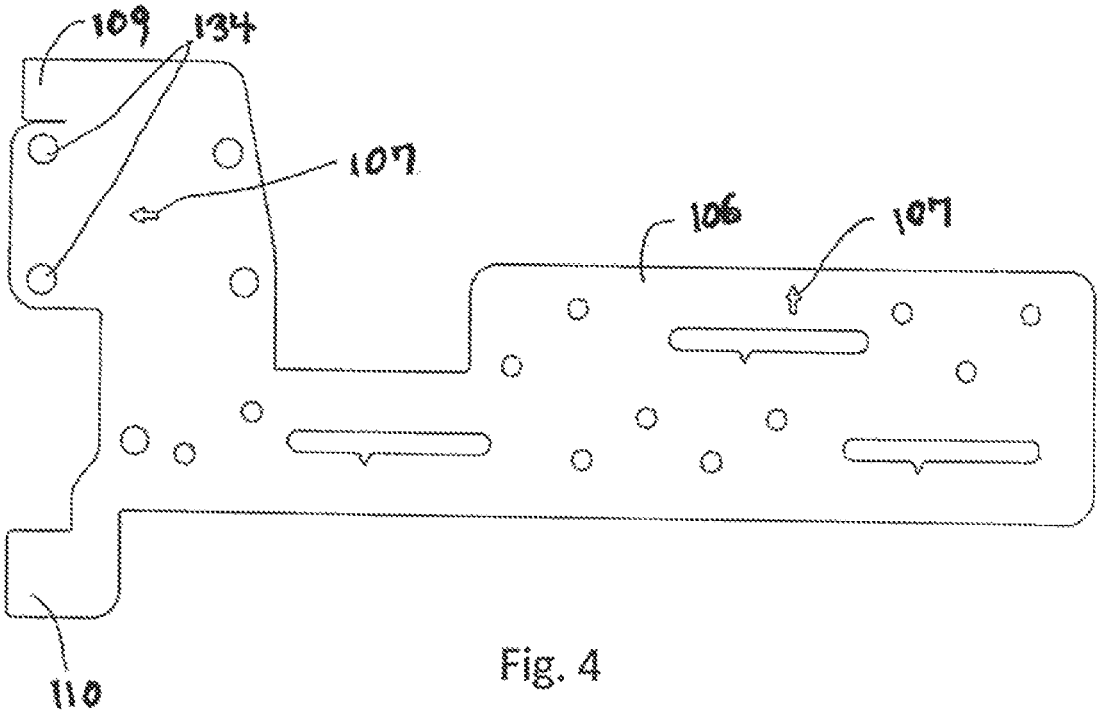
FIG. 4 shows the mounting bracket of FIGS. 2 and 3 as stamped from sheet metal and before portions of it have been bent to as shown in FIGS. 2 and 3.

Mounting brackets 106 may be stamped from a single sheet of sheet metal as shown in FIG. 4, while simultaneously stamping out appropriate holes and slots and arrows 107. As shown if FIGS. 2 and 3 portions of the stamped metal may be bent to form a back flange 108, which includes hook 109, stop 110 and holes to secure the bracket to the brace 111 or wall attachment means, 112, 113. The mounting brackets are preferably placed against the inside surface of the side walls 114 or a center partition 104, and attached thereto by screws 115 inserted through slots 116.

Figure 8:
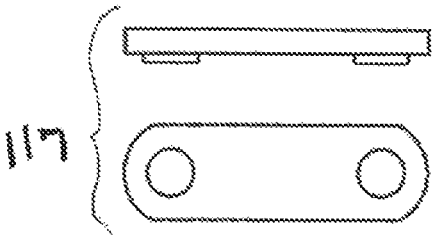
FIG. 8 shows a channel nut which may be inserted into the channels shown in FIGS. 5-7 and used to secure a mounting bracket or reinforcement to these channels or to the brace shown in FIG. 9.
Figure 15:
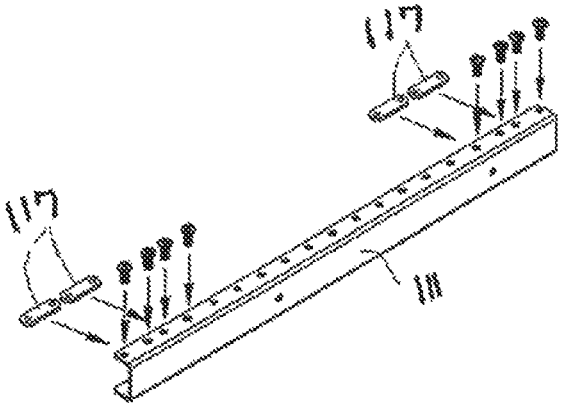
FIG. 15 shows a representative brace of FIG. 9 and channel nuts of FIG. 8 with screws showing where they can be placed in the brace.

Upon delivery to the installation site, the fixture may be installed per the following method. As shown in FIG. 15, loosely attach two channel nuts 117 on each end of brace 111 by inserting ½" bolts through each of the four outer holes on each end of the brace. Position channel nuts 117 inside brace 111 with the bulges down (see FIG. 8).

Figure 9:
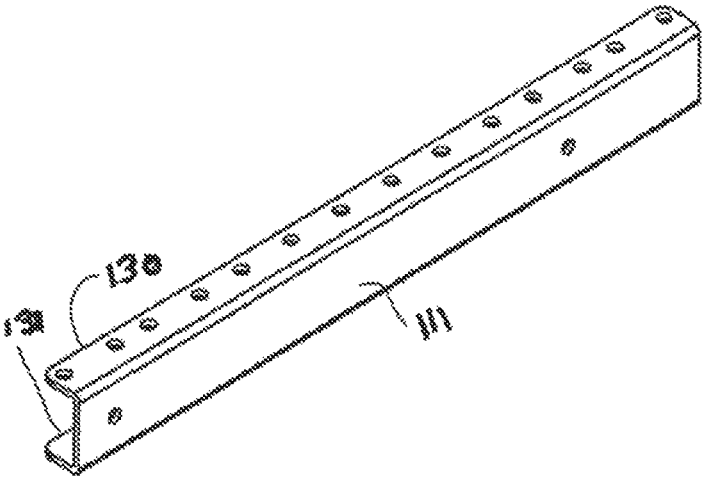
FIG. 9 shows a brace that channel nut with two bolts.
Figure 16:
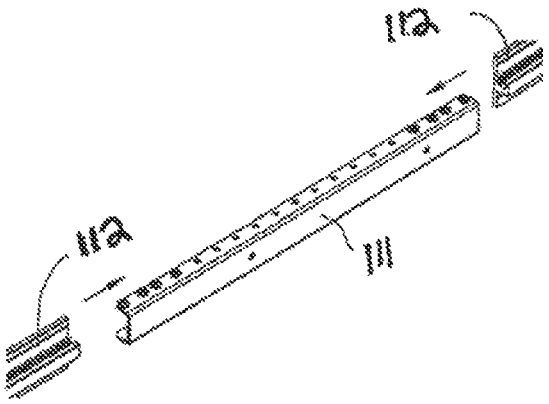
FIG. 16 shows two wall attachment members having channels and rails and with a brace sized to fit over the rails to secure the wall attachment members in a linear orientation.
Figure 17:
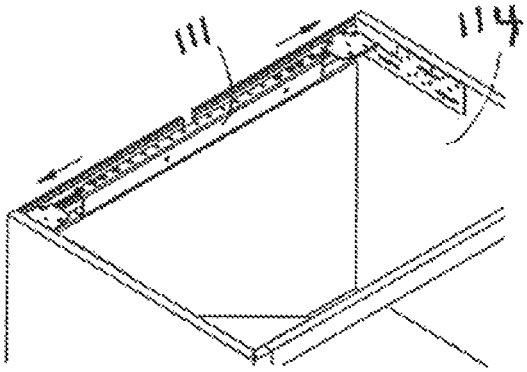
FIG. 17 shows a fixture with two mounting brackets in which the hooks of the mounting brackets are inserted into the hook receiving members of the wall attachments members, and showing how the brace may be horizontally slid to a desired location along the rails/channels of the wall attachment members.
Figure 19:
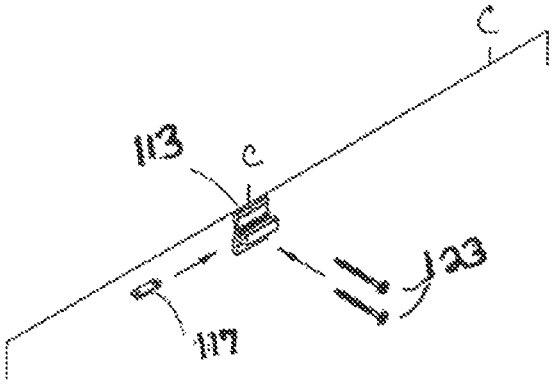
FIG. 19 shows the location of a smaller wall attachment member positioned over a wall stud location as shown in FIG. 13, and how a channel nut may be inserted into the channel of the smaller wall attachment member.
Figure 20:
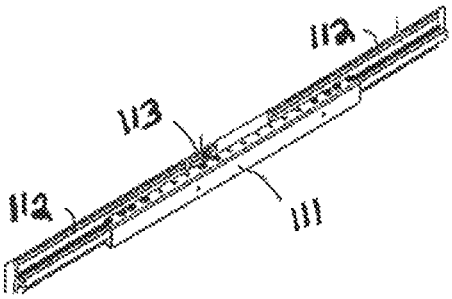
FIG. 20 shows a linear orientation of three wall attachment members and a brace securing them together.
Figure 21:
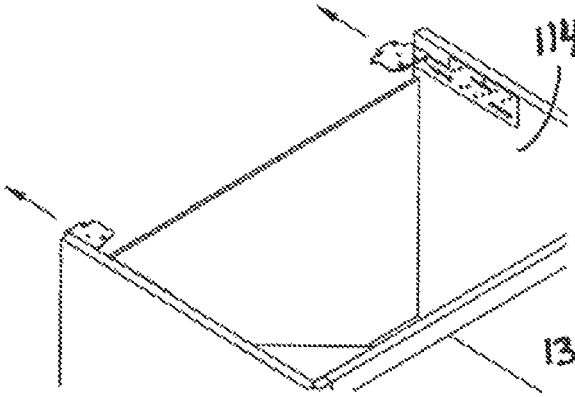
FIG. 21 shows a fixture with mounting brackets that are extended so the hooks on the brackets are ready to be inserted into hook receiving structures of the wall attachment members.

As shown in FIG. 16, slide wall attachment members 112 onto the channel nuts 117 on each end of brace 111. A third wall attachment member may be used if necessary to position it over a wall stud location. If so, a channel nut may be inserted into the channel of the smaller wall attachment member as shown in FIG. 19. In one embodiment, the overall width of the wall attachment members and brace (if used) may be ¼" less than the overall inside distance between the side walls of the fixture. To set the width, place the wall attachment member and brace assembly inside the fixture and slide the wall attachment members tight against the fixture sides. Preferably, center the brace(s) so they overlap the wall attachment members 112 rails equally, then retract each wall attachment member approximately ⅛" from the sides of the fixture, and tighten all the bolts securing the wall attachment member(s) to the center brace(s) to form a wall attachment assembly. In one embodiment, brace 111 has a generally C-shaped cross section as shown in FIG. 9 with upper and lower edges 130, 131 such that when secured to the at least one wall attachment members as shown, for examples, in FIGS. 18 and 20, the upper and lower edges abut the wall attachment members. This geometry further strengthens the wall attachment member and brace assembly.

It will be appreciated that while these steps describe an installation in which multiple wall attachment members held together by a brace are used, a single wall attachment member may be used without a brace. For such an instance, the single wall attachment member should have a width that about ¼" less than the distance between the side walls 114 of the fixture.

Figure 13:
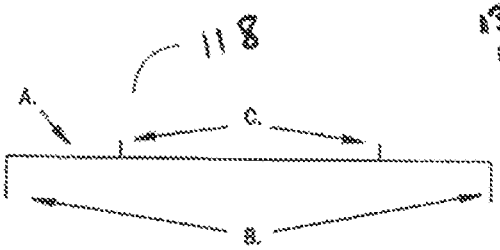
FIG. 13, shows representative locations on a wall for attaching wall attachment members to a wall and representative locations of wall studs.

Next, as shown in FIG. 13, the fixture location on the wall 118 may be marked by drawing a horizontal line A on wall 118 where the top of the fixture will be located. Vertical lines B may be drawn on wall 118 where the sides of the fixture will be located. A stud finder may be used to locate wall studs between the vertical marks. After locating the studs, it is desirable to find the center of the studs for maximum strength. To find the center, either use a stud finder or use a drill with a ⅛" drill bit to drill holes to the left and right of the stud until the edges are found. Then a pencil may be used to draw a vertical line C in the center of each stud up 1" from horizontal line A.

Figure 18:
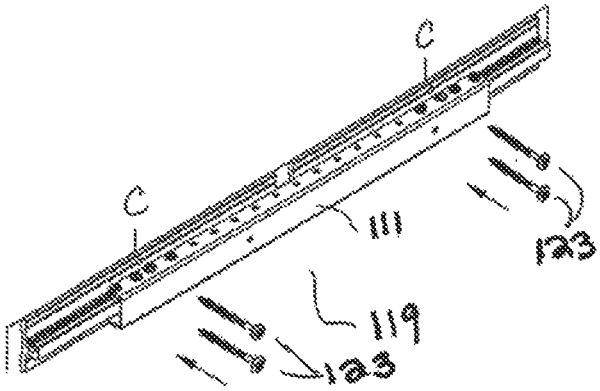
FIG. 18 shows a linear orientation of two wall attachment members positioned over wall stud locations as shown in FIG. 13, and the locations for screws to secure the wall attachment members to the wall.

Next, as shown in FIG. 18, the stud center locations are copied to the wall attachment assembly 119 by holding the assembly against the wall and marking on the assembly the locations of the wall studs C on the rail assembly 119. The assembly may be set on a surface suitable for drilling. Using a 5/16" drill bit, a hole is drilled aligned with each of mark through the upper v-groove 121 on the top half of the wall attachment member(s). A second hole is drilled aligned vertically with the first hole in the lower v-groove 122 on the bottom half of the wall attachment member(s). After the holes are drilled (two per stud), the wall attachment assembly is held against the wall and aligned with the stud center locations and the placement line drawn on the wall. Structural screws 123 are driven through the drilled holes.

Figure 5:
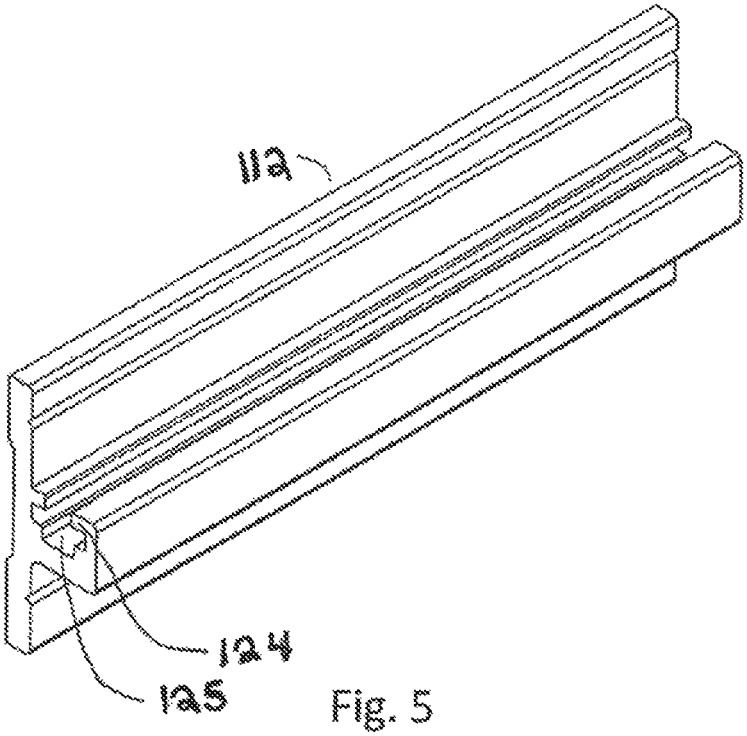
FIG. 5 shows a wall attachment member having rail and a hook receiving member which is particularly suitable for attaching to an area of wall where the sides of the fixture will be located.
Figure 6:
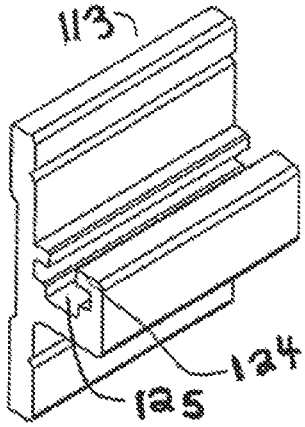
FIG. 6 shows a wall attachment member having rail and a hook receiving member, but with a smaller width, which is particularly suitable for attaching to an area of wall having stud.
Figure 7A:
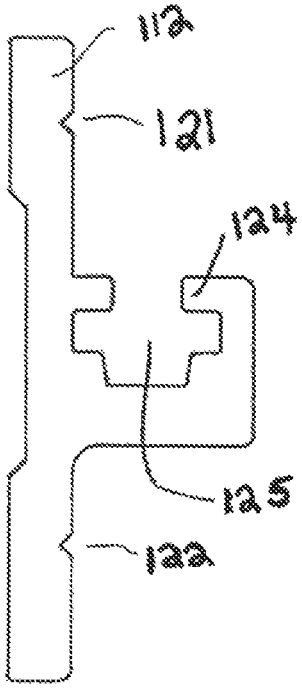
FIGS. 7A, 7B and 7C are side views of alternate embodiments of wall attachment members having rails and channels in which the channel is open to the top, bottom and front, respectively.
Figure 7B:
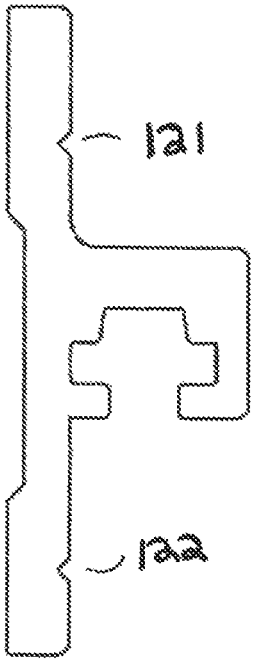
Figure 7C:
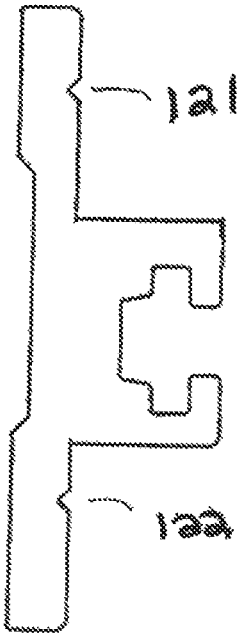
Figure 23:
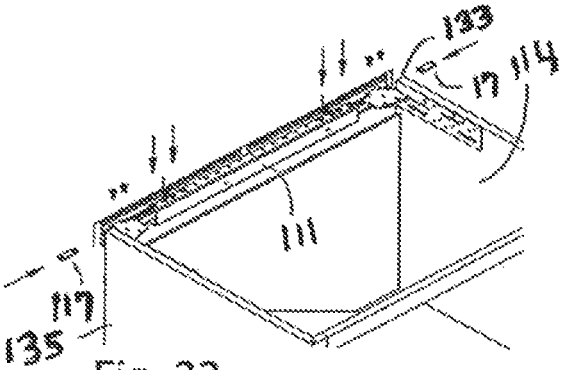
FIG. 23 shows a fixture with extended mounting brackets of FIG. 21 mounted on the wall attachment members and showing how the channels of the wall attachment members are exposed so that channel nuts may be inserted into the channels.
Figure 24:
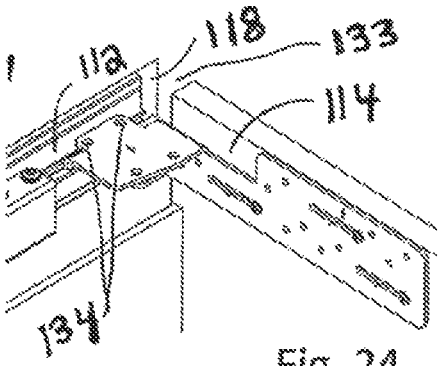
FIG. 24 is a close up view of the right mounting bracket of FIG. 23 showing how its hook is hooked into the hook receiving surface of the wall attachment member, and how the extension of the mounting bracket from the side wall of the fixture is facilitated by the slots and screws. A side view of these components is shown in FIG. 30.
Figure 25:
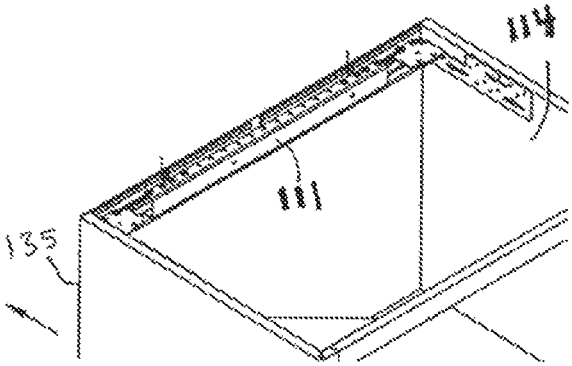
FIG. 25 shows how the fixture shown in FIG. 23 may be pushed against the wall so the back edges of the side walls are flush with the wall and the mounting system components are not exposed.
Figure 30:
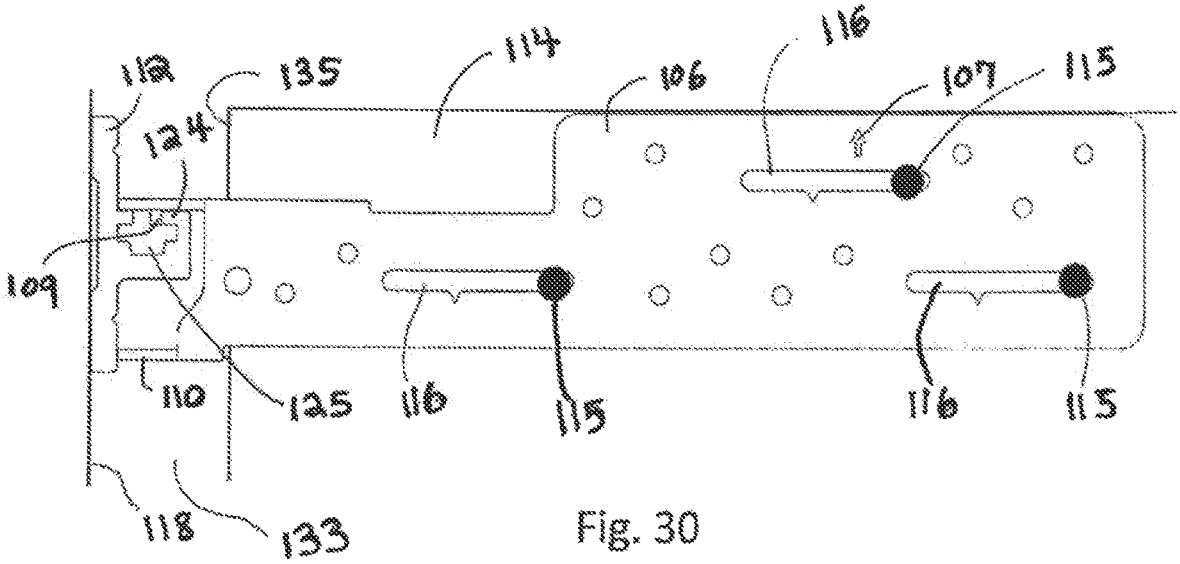
FIG. 30 is a side view of a mounting bracket with its hook inserted into a hook-receiving structure of a wall attachment member, and with the bracket extending from the fixture as permitted by the slots and loosened screws.

To install the fixture, ensure the screws 115 attaching the mounting brackets 106 to the side walls 114 are loosened, and slide the brackets as far back as possible (out the back of the fixture) as shown in FIGS. 23, 24 and 30 and tighten one screw on each bracket. The fixture is lifted and the hook 109 of each mounting bracket is hooked to the hook-receiving structure 124 (see FIGS. 5, 6 and 7A) of one or more wall attachment members. Those of skill in the art will appreciate geometries for the hook of the mounting backet and hook-receiving structure of the wall attachment members may be varied. For example, in the wall attachment members shown in FIGS. 5, 6 7A, 30 and 31, an upwardly facing channel 125 is shown which includes hook-receiving structure 124, which receives a downwardly facing hook 109 of the mounting bracket. Different geometries for a wall mounting member are shown in FIGS. 7B and 7C, and those of skill in the art can easily configure hook-receiving structures on them that receive mating hooks on mounting backets. Also, what is referred to a hook-receiving structure on the wall attachment members FIGS. 5, 6 7A, 30 and 31 could also be considered a hook and what is referred to a hook on the mounting bracket in FIGS. 2, 3, 30 and 31 could be considered to be hook-receiving structures, so these terms are interchangeable. All that is required is that the geometries be such that a fixture can be at least temporarily held by the wall attachment member long enough for a more reliable securement means to be used to secure the mounting bracket to the wall attachment member.

As shown in FIGS. 2, 3 30 and 31 The mounting bracket may include a stop 110. When hook 109 of mounting bracket 106 engages with the hook receiving surface 124 of the wall attachment member 112, the geometries of the hook and stop are such that they hold the mounting bracket perpendicular to the wall 118.

Figure 22:
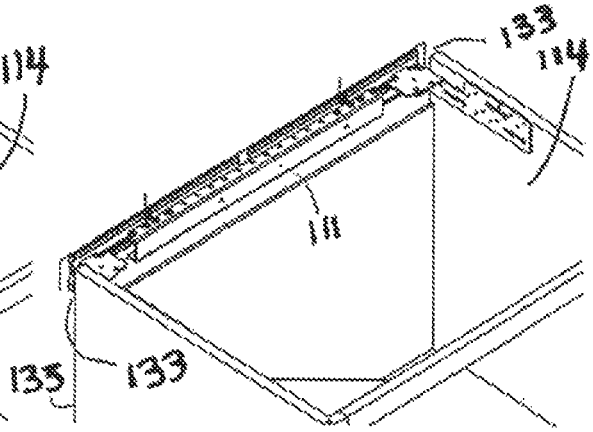
FIG. 22 shows a fixture with extended mounting brackets of FIG. 21 mounted on the wall attachment members such that the fixture is spaced from the wall.
Figure 26:
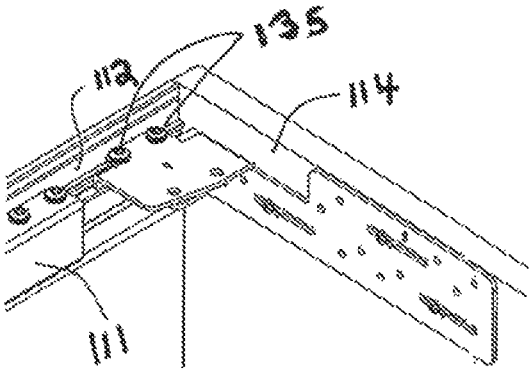
FIG. 26 is a close up view of the right mounting bracket of FIG. 25 showing how it has been secured to a wall attachment member with channel nuts and how the moving the fixture to be flush against the wall has caused the mounting bracket to move relative to the side wall of the fixture. The locations of the screws holding the bracket to the side wall are at a different location in the slots of the mounting bracket, as further shown in FIG. 31.

After the mounting bracket 106 is hooked to the wall attachment member 112 allowing the fixture to hang from the wall, there may be a gap 133 between the wall the back edges 135 of the side walls of the fixture as shown in FIGS. 22, 23 and 24. As shown in FIG. 23, channel nuts 117 may be slid into the channel on each side of the at least one wall attachment members until the holes in the channel nuts align with holes 134 in the back flange 108 of mounting bracket 106 as shown in FIG. 24. As shown in FIG. 26, screws 135 are driven through the holes 134 in the mounting bracket and into the channel nuts 117 which are held by the wall attachment member to securely affix the fixture to the wall attachment member.

Figure 27:
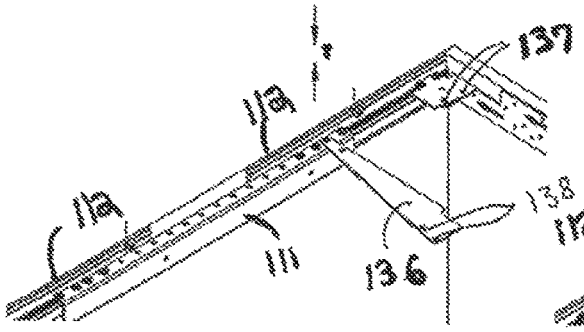
FIGS. 27-29 show the sequence of attaching and securing a reinforcement to the brace and mounting bracket using channel nuts to provide further structural support for the mounted floating fixture.
Figure 28:
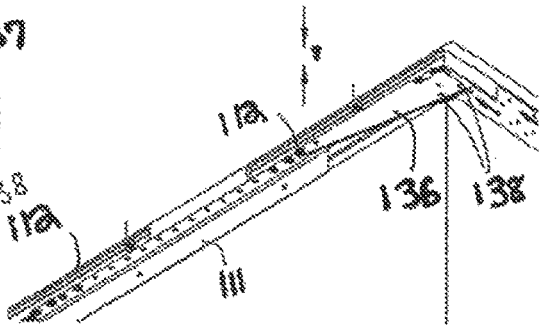
Figure 29:
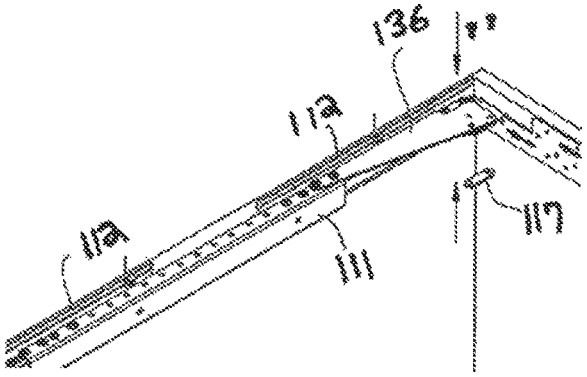

If further structural support for holding the fixture to the wall is desired a reinforcement member 136 may screwed between the brace or a wall attachment member, and the mounting bracket, as shown in FIGS. 27-29. To facilitate this connection, the mounting bracket may be provided with additional holes 137 (see FIGS. 2, 3 and 27) that will match up with holes 138 in reinforcement 136, and for consistency in the hardware used for the disclosed system, channel nuts 117 and screws may be used to secure the reinforcement 136 to mounting bracket 106.

Figure 31:
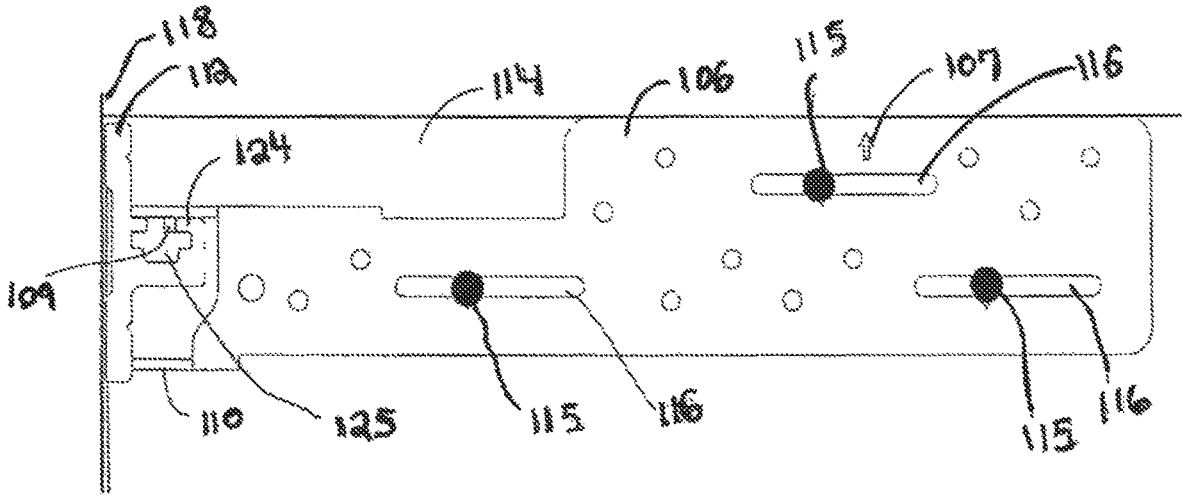
FIG. 31 is a side view of a mounting bracket and wall attachment member of FIG. 30, but with the bracket retracted so the back edge of the side wall of the fixture is flush with the wall. In the position, the screws attaching the mounting bracket to the side wall may be tightened.

After the fixture has been secured to the wall attachment members, the fixture may be moved with respect to the mounting brackets 106 so that the back edges 135 are flush with or abut wall 118. To do this, the installer should ensure that the screws 115 that pass through the slots 116 of mounting brackets 106 are sufficiently loose, as shown in FIG. 30. Then the fixture is moved toward the wall until the back edge abuts the wall as shown in FIG. 31. This movement closes the gap 133 between the back edges and wall 118. Screws 115 are then tightened to secure the mounting brackets 106 the fixture 101.

If desired, other components may be added fixture 101. For example, a top may be installed or drawers or doors may be installed on the front of fixture 101. With the components, kit and methods described herein, the speed and ease of mounting the fixture to a wall to create a floating fixture is improved. The flexibility of the system may allow installation without the need to cut components at the installation site.

Figure 14:
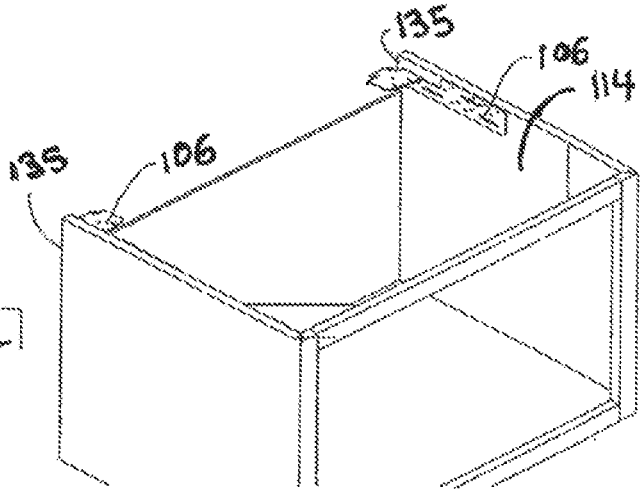
FIG. 14 shows representative wall-mountable fixture having brackets attached to the left and side walls.

While one embodiment uses channel nuts, other embodiments may use spring nuts as shown in FIGS. 13 and 14. Spring nuts are similar to simpler channel nuts but have a spring on one side that keeps the nut flush against the inside piece of the t-rail. This allows the nut to stay in place while an installer affixes the bolts and tightens them down. Alternatively, an installer could also use stud nuts as shown in FIG. 15.

Figure 10:
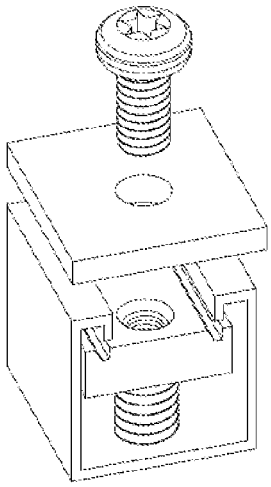
FIG. 10 shows a channel nut that is a first embodiment of a spring channel nut, and which may be inserted into the channel of a wall attachment member.
Figure 11:
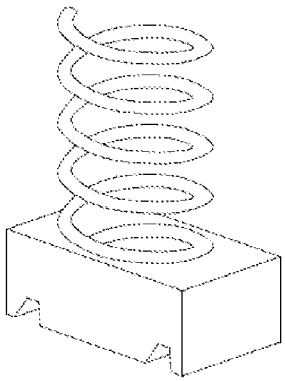
FIG. 11 shows a channel nut that is a second embodiment of a spring channel nut, and which may be inserted into the channel of a wall attachment member.
Figure 12:
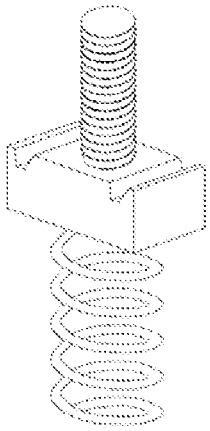
FIG. 12 shows a channel nut that is an embodiment of a stud nut which may be inserted into the channel of a wall attachment member.

Those of skill in the art will understand that various details of the invention may be changed without departing from the spirit and scope of the invention. Furthermore, the foregoing description is for illustration only, and not for the purpose of limitation, the invention being defined by the claims. The term "fixture" as used herein is in the broadest sense and could include fixtures or furniture items such as vanities, cabinets, desks, benches, dressers, nightstands or shelves, and can be mounted to a wall and that do not extend to a floor to support their weight. Moreover, while these furnishings or furniture often include tops, door or drawers, the term "fixture" as used herein and in the claims does not require these components. For example, FIG. 1 shows a fixture that could be considered a vanity, even though it does not have a top with a sink that is often included in a vanity, nor does it include the drawers or front drawers. Despite the lack of these elements, it is considered a fixture because it is mountable to a wall as described herein so that its weight. The term fixtures also includes wall-mountable appliances, such as microwave ovens, washers and dryers. A defining characteristic of a fixture as used here is that it has opposing side walls (or edges) and at least one structure connecting those sides. For example, fixture shown in FIG. 1 has both a back wall and a bottom that connect the sides. A fixture does not necessarily need to have a top, or drawers or doors. A shelf is considered a fixture, as is a cove, i.e., an empty box without a front into which an item such as a microwave may be inserted. Channel nuts a described above as means to secure various components to each other. Channel nuts include a variety of configurations, such as the simple embodiments shown in FIG. 8, or those having springs or studs as shown in FIG. 10, 11 or 12. In addition, while fixed structures comprising the hook and hook-receiving components are shown, flexible components are also within the spirit and scope of the claims. For example, a hook or a hook receiving structure could include a cable having a hook or a loop. The only requirement is that the cooperating structures be sufficient to temporarily hold the fixture off the ground and attached of the wall mounting structure until additional components are added to more securely affix the fixture to the wall.

While the invention has been illustrated and described in detail in the foregoing drawings and description, the same is to be considered as illustrative and not restrictive in character, it being understood that only illustrative embodiments thereof have been shown and described and that all changes and modifications that are within the scope of the claims are desired to be protected.

All references cited in this specification are incorporated herein by reference to the extent that they supplement, explain, provide a background for or teach methodology or techniques employed herein.

What is claimed is:

1. A floating fixture wall mount system for a fixture having a left side and a right side that are spaced apart, the left and right sides each having a back edge, the system comprising:

at least one wall attachment member securable to a wall, each wall attachment member comprising:

a wall-facing side;

a fixture-facing side;

the fixture-facing side comprising a hook-receiving structure and a channel nut receiving groove;

left and right mounting brackets, each bracket comprising:

an arm attachable to a side of the fixture;

a wall-facing end comprising a hook insertable into the hook-receiving structure of the at least one wall attachment member to thereby hold the bracket and the fixture to the wall attachment member;

a flange for abutting the wall attachment member that comprises at least one aperture;

for each mounting bracket, a channel nut for attaching the mounting bracket to the channel nut receiving groove of the at least one wall attachment member to thereby secure the fixture to a wall such that the bottom of the fixture is spaced from the floor and the back edges of the left and right sides are flush with the wall.

2. The floating fixture wall mount system of claim 1 wherein each mounting bracket further comprises a stop configured to prevent the bracket from pivoting with respect to the at least one wall mounting structure when the hook of the mounting bracket is placed in the hook-receiving structure.

3. The floating fixture wall mount system of claim 2 wherein the stop is configured to engage the wall mounting structure beneath the hook-receiving structure and orient the mounting bracket perpendicular to the wall when the hook is placed in the hook-receiving structure.

4. The floating fixture wall mount system of claim 1 wherein the arm of each mounting bracket comprises at least one slot therein, and further comprising a screw passing through the at least one slot such that when loosened allows the bracket to move relative to a side of the fixture, and when tightened secures the mounting bracket to the fixture while allowing the back edges of the left and right sides to be flush with the wall.

5. The floating fixture wall mount system of claim 1 further comprising a reinforcement member further securing one of the left or right mounting brackets to one of the at least one wall attachment members.

6. The floating fixture wall mount system of claim 1 wherein the channel nut comprises a spring nut.

7. The floating fixture wall mount system of claim 1 wherein the channel nut comprises a stud nut.

8. The floating fixture wall mount system of claim 1 wherein each mounting bracket is formed from a single sheet of metal.

9. The floating fixture wall mount system of claim 1 wherein the at least one wall attachment member comprises two wall attachment members, and further comprising a brace securely connecting the two wall attachment members in a linear orientation.

* * * * *